US006263715B1

(12) United States Patent
Blazley

(10) Patent No.: US 6,263,715 B1
(45) Date of Patent: Jul. 24, 2001

(54) COLD-FORMING

(76) Inventor: Wade Hylton Blazley, "Wirraway", Carcoar NSW 2791 (AU)

( * ) Notice: Subject to any disclaimer, the term of this patent is extended or adjusted under 35 U.S.C. 154(b) by 0 days.

(21) Appl. No.: 09/381,577

(22) PCT Filed: Mar. 18, 1998

(86) PCT No.: PCT/AU98/00175

§ 371 Date: Nov. 30, 1999

§ 102(e) Date: Nov. 30, 1999

(87) PCT Pub. No.: WO98/45064

PCT Pub. Date: Oct. 15, 1998

(30) Foreign Application Priority Data

Apr. 3, 1997 (AU) ..... PO 6005

(51) Int. Cl.[7] ..... B21D 13/04
(52) U.S. Cl. ..... 72/187
(58) Field of Search ..... 72/160, 161, 170, 72/187

(56) References Cited

U.S. PATENT DOCUMENTS 4,030,335 * 6/1977 Allenspach ..... 72/170
4,364,253 * 12/1982 Knudson ..... 72/187
5,819,575 * 10/1998 Kobayashi et al. ..... 72/187

FOREIGN PATENT DOCUMENTS 2311741A 8/1997 (GB) .
64-66022 * 3/1989 (JP) ..... 72/186

* cited by examiner

*Primary Examiner*—Lowell A. Larson
(74) *Attorney, Agent, or Firm*—Larson & Taylor PLC

(57) ABSTRACT

A continuous cold-forming of strip material is used to produce building elements having transverse ribs extending across at least part of the element. The inherent adverse tendency of thin strip to twist and distort as it issues from a transverse rib forming device is prevented by providing a stress relief device for applying a compression load to the transverse ribs immediately downstream of each pair of transverse rib-forming rolls. The stress relief device includes a first roller device and a second roller device forming a nip for receiving the ribbed strip, wherein each roller device is disposed to engage an outer crest portion of each rib projecting towards it. The second roller device includes a pair of substantially parallel coextensive spaced-apart second rollers and the first roller device includes a first roller, the first roller being substantially parallel to, coextensive with and equi-spaced from each of the second rollers.

32 Claims, 8 Drawing Sheets

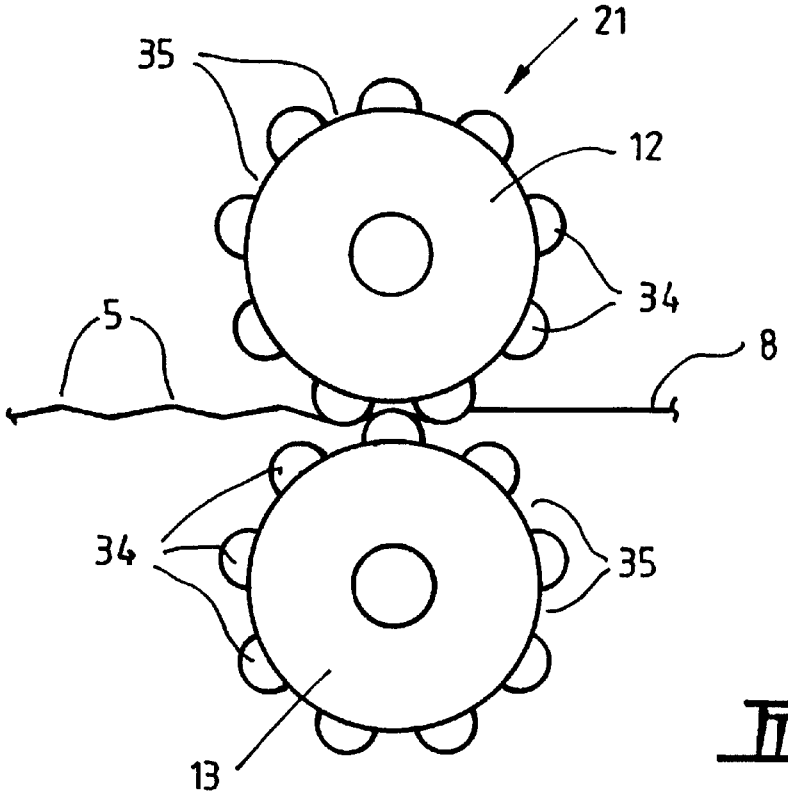
FIG. 5.
FIG. 6.
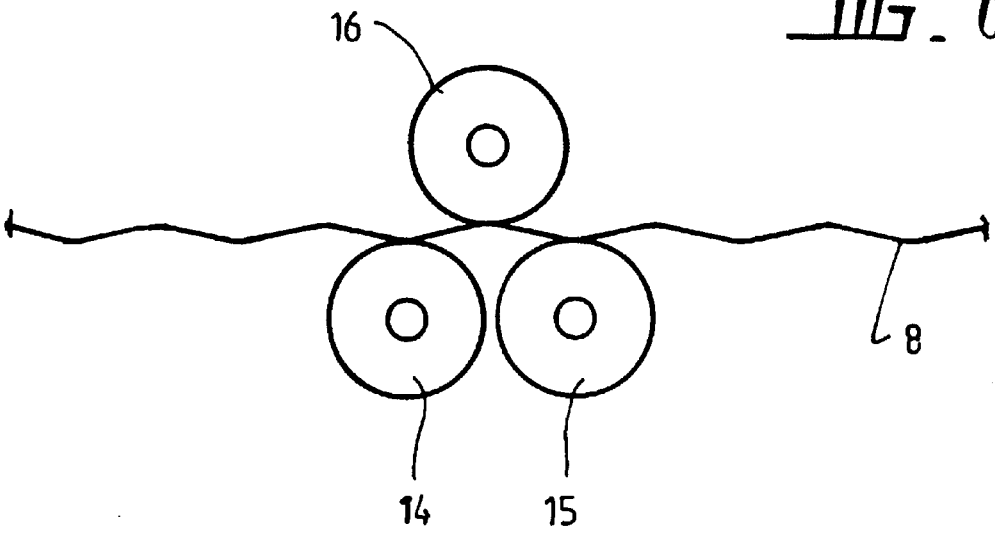

COLD-FORMING

The present invention relates to continuous cold-forming of strip material and particularly but not exclusively to sheet metal strip to produce building elements having transverse ribs extending across at least part of the element.

In a continuous cold-forming line for forming such elements a strip is generally passed to a rib-forming stand where the strip is passed through the nip of a pair of cylindrical rolls having respectively a plurality of mating projections and recesses, elongated axially of the rolls and spaced apart on their circumference. Generally the rolls are geared to each other to maintain mating projections and recesses in register with each other thereby portions of the strip material are pushed into the recesses to permanently deform the strip to form the ribs.

However it has been found that continuous cold-forming of transverse ribs in strip by such means generally produces undue residual stresses in the strip, which can cause twisting, buckling and other warping of the formed strip.

A number of prior art proposals have been put forward to continuously cold-form transverse ribs in strip. For example;

U.S. Pat. No. 3,673,838 describes a cold-forming line for continuously forming transverse stiffening ribs on metal strip, the line having a set of transverse rib forming rolls intermediate a back tension roll and a forward tension roll, wherein the strip passing through the nip of the rib-forming rolls is held in tension by the forward and back tension rolls. The forward tension roll and the die roll (one of the rib-forming rolls) form a nip through which the ribbed strip is passed. The forward tension roll engages the back face of the strip devoid of projecting ribs while the ribs remain in recesses in the die roll.

U.S. Pat. No. 3,394,573 describes apparatus for continuously cold-forming transverse corrugations on metal strips, the apparatus having a set of corrugating rolls intermediate a back tension roller set and a forward tension roller set. The formed strip has a web provided with transverse corrugations and cold-formed side flanges. The back tension roller set cold-forms the flanges and tightly holds the strip in the nip between the rollers. The forward rollers conform to the form of the strip passing through the rotating die rolls. That is to say that they are provided with respective mating projections and recesses corresponding to those of the die rolls.

U.S. Pat. No. 4,027,517 also describes cold-forming apparatus for providing strip with transverse corrugations between profiled longitudinal flanges. The apparatus comprises continuous corrugating embossing means and means to hold the strip under tension as it passes through the embossing means. In one of the embodiments described a roll is provided downstream of a downstream tensioning roll to apply "flattening pressure on the sheet metal". The flattening roll engages only those portions of the sheet that have not been induced into die recesses and portions of the sheet metal between transverse indentations.

U.S. Pat. No. 4,059,000 also describes apparatus for continuously cold-forming transverse corrugations on metal strips, the apparatus including means to maintain the strip in tension as it passes through embossing rolls and straightening/flattening means.

In all the above proposals the strip passing through the nip of the rib-forming rolls is held in tension, and in many, the line is further provided with downstream straightening means.

U.S. Pat. No. 3,137,922 proposes a somewhat different approach in that it proposes a cold-forming/working line for continuously forming metal roof panels having centrally disposed transverse stiffening ribs from metal strip in which the line includes a plurality of flange forming stations, a combined cold-reducing and embossing stand and straightening roll stands. The combined cold-reducing embossing stand is provided with cold-reduction/drawing means to variably elongate the central portion of the strip prior to the strip being passed through the nip of a pair of embossing rolls which provide transverse ribs in said central portion of the strip. The embossing rolls are geared to each other to maintain mating projections and recesses in register with each other. The straightening stand comprises a downstream roll stand having a number of sets of upper and lower rolls engaging only the flanges of the strip to straighten any irregularities in the flanges resulting from the cold working and embossing operations and for drawing the strip through the apparatus. Intermediate the downstream roll stand and the embossing rolls the strip is passed beneath a manually operated downwardly-moveable wooden shoe for engaging the upper surface of the embossed sheet, said upper surface being devoid of transverse ribs, "to relieve rolling stresses resulting from the embossing operation and thus preventing later distortion and twisting of the panel". Intermediate the flange-engaging portions of the upper and lower rolls in the downstream roll stand there is further provided a manually operable upwardly-acting pad underlying the strip for engagement therewith to assist in the further relief of embossing stresses. Thus when flanges of the strip are gripped by the upper and lower rolls, a lever is manually operated so that the central portion of the strip is engaged by the pad. This proposal addresses the problem of providing transverse ribs by (1) providing upstream pre-conditioning or pre-elongating means for the central portion of the strip prior to that portion entering the rib-forming nip, (2) providing downstream flange gripping straightening means to straighten irregularities and to draw the strip from the rib-forming rolls, thereby tensioning the strip as it passes through the nip of the embossing rolls.

Other problems associated with prior art proposals include the complexity and cost of the cold-forming line and in the latter proposal the need to manually control some of the operations.

The present invention is particularly but not exclusively directed to a method and apparatus for continuously cold-forming strip to produce building elements having a generally channel shaped cross-section comprising a web and side walls in which the web is provided with longitudinally extending strengthening ribs and the side walls are provided with transverse ribs or corrugations extending across at least part of each side wall, of the kind described in Australian patent application number AU 48883/90. In this document each free edge margin of each side wall is flanged by downstream rolls engaging only the edge margins of the strip. It has been found that formed strip issuing from apparatus of this kind is also prone to twisting, buckling and other warping.

An object of the present invention is to addresses one or more of the problems of the prior art.

The present invention provides a cold-forming line for continuously forming metal building elements having transverse ribs extending across at least part of the element from strip, comprising means for forming transverse ribs in the strip and stress relief means for applying compression load to the transverse ribs wherein said stress relief means comprises a first roller means and a second roller means forming a nip for receiving ribbed strip, wherein each roller means is adapted to engage an outer crest portion of each rib projecting towards it.

It is preferred that the second roller means comprises a pair of substantially parallel coextensive spaced apart second rollers.

Preferably the first roller means comprises a first roller, said first roller being substantially parallel to, coextensive with and equi-spaced from each of said second rollers.

It is preferred that each roller applies a compression load to its respective ribs to at least partially relieve stresses in the strip produced by the rib forming means and more preferably the rollers engage only the outer crest portions of the respective ribs.

It is preferred that the second rollers lie in a common plane substantially parallel to the plane of the strip and are spaced apart so that their longitudinal axes are spaced apart a distance corresponding to the distance between crests of adjacent ribs projecting towards them.

The first and second rollers may be set a predetermined distance from the nominal plane of the strip, said distance being less than the height of the ribs from the nominal plane of the strip. The predetermined distance may be sufficiently less than said height so that the rollers compress the crest portions of the respective ribs without permanent deformation thereof to effect at least partial relief of stress therein. Over compression may cause permanent deformation of the ribs, whereas too little compression may have little or no effect on the strip. The predetermined distance may be set prior to the commencement of operation or immediately thereafter. The relative displacement of the rollers from the nominal plane may be adjusted during operation of the line with the displacement being set once substantially straight, strip substantially devoid of unwanted distortion (distortion free) begins to issue from the line. Additionally, the stress relief means according to the invention may be adjusted and set to account for variations in the quality of the strip issuing therefrom that may occur during operation of the line.

It is preferred that the line further comprises flange forming means and that the stress relief means is provided immediately downstream of the rib-forming means.

It is preferred that the transverse rib forming means comprises a pair of cylindrical rolls having respectively a plurality of mating projections and recesses, elongated axially of the rolls and spaced apart on their circumference. The cylindrical rolls form a nip through which the strip passes and the rolls may be geared to each other to maintain mating projections and recesses in register with each other thereby portions of the strip material are pushed into the recesses to permanently deform the strip to form the ribs.

It is preferred that the transverse ribs comprise corrugations. The corrugations may, for example, be substantially sinusoidal in cross-section.

The present invention also provides a method of cold-forming metal building elements having transverse ribs extending across at least part of the element from strip, comprising the steps of passing strip to means for forming transverse ribs in the strip and passing the ribbed strip to stress relief means for applying compression load to the transverse ribs wherein said stress relief means comprises a first roller means and a second roller means forming a nip for receiving ribbed strip, wherein each roll means is adapted to engage an outer crest portion of each rib projecting towards it.

In order that the invention may be more fully explained particular embodiments will be described in detail with reference to the accompanying drawings in which:

FIG. 5 is a view of important components of the apparatus illustrated in FIG. 2.

FIG. 6 is a view of important components of the apparatus illustrated in FIG. 2.

Figure 1:
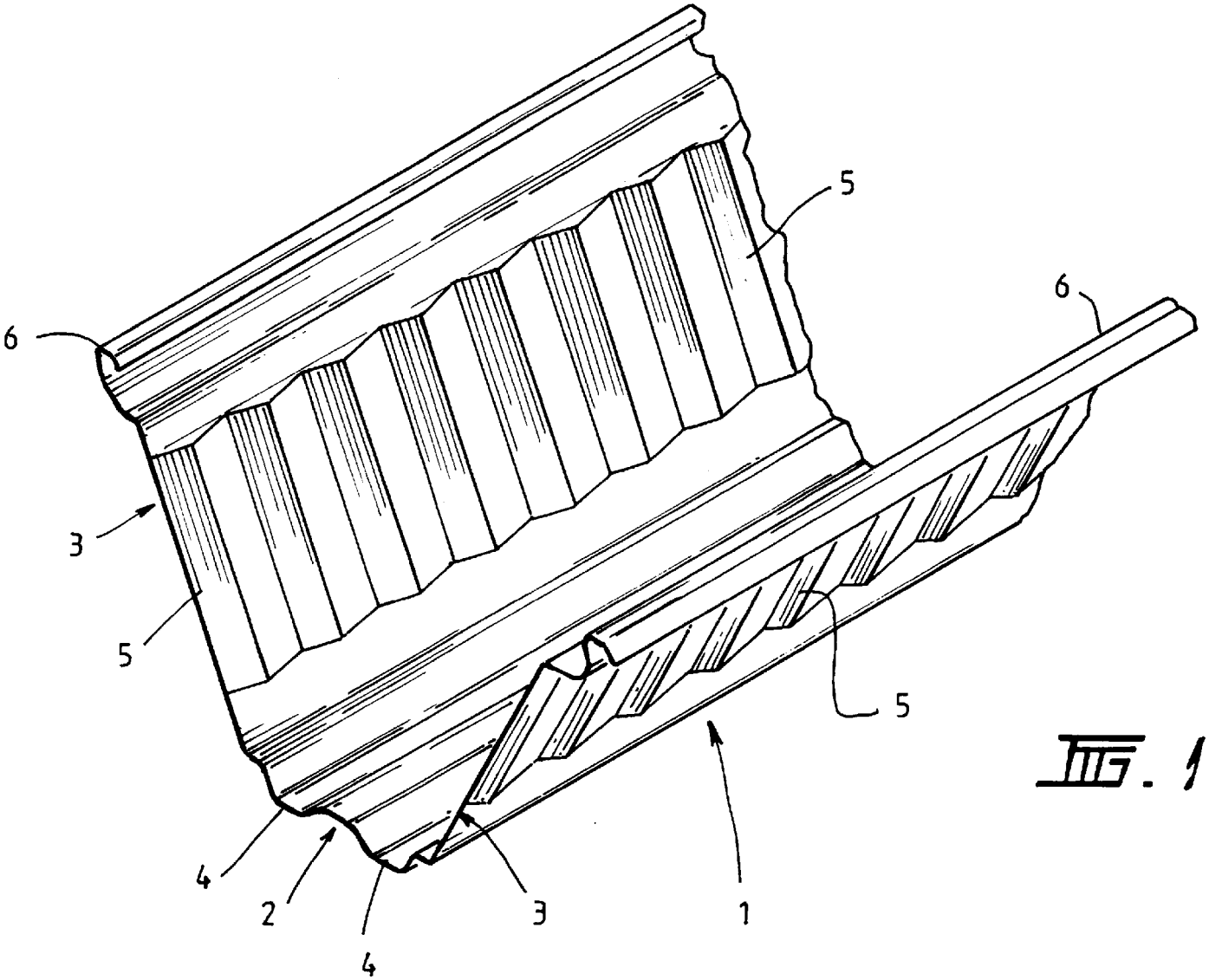
FIG. 1 illustrates a perspective view of a building element formed in accordance with the invention.
Figure 2:
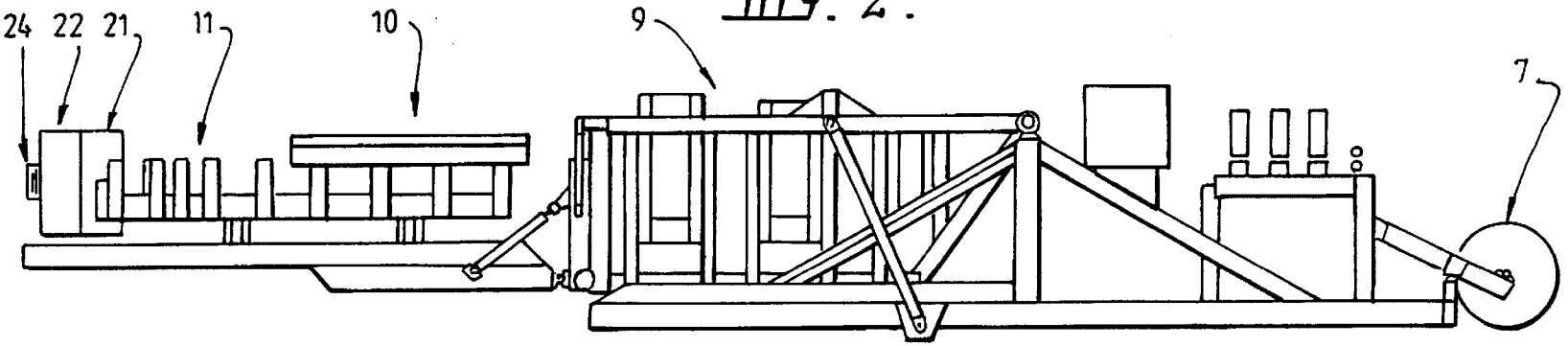
FIG. 2 is a side view of apparatus for forming the element illustrated in FIG. 1.
Figure 3:
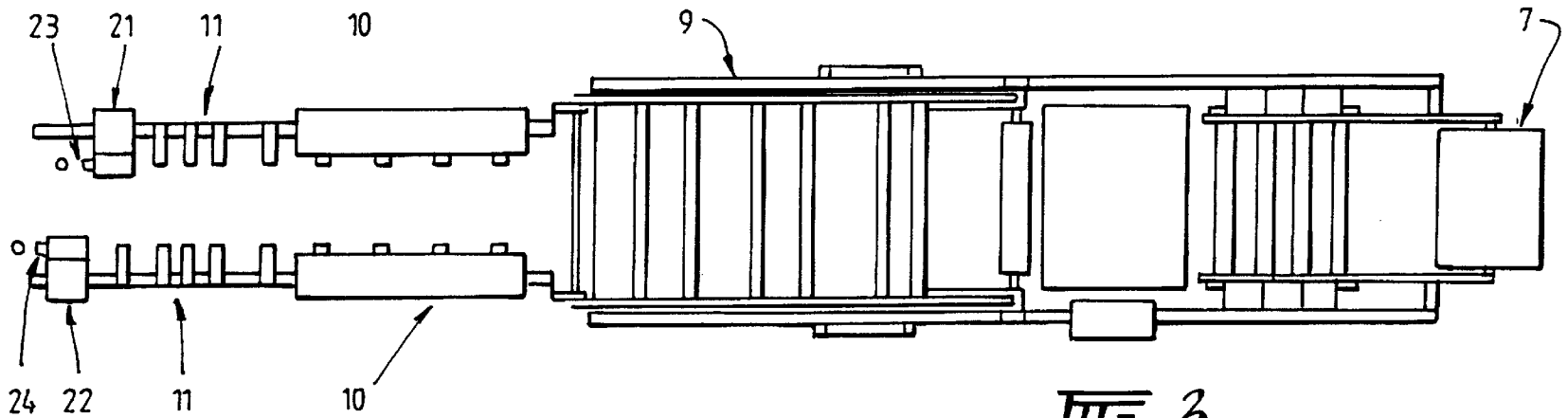
FIG. 3 is a plan view of apparatus illustrated in FIG. 2.
Figure 4:
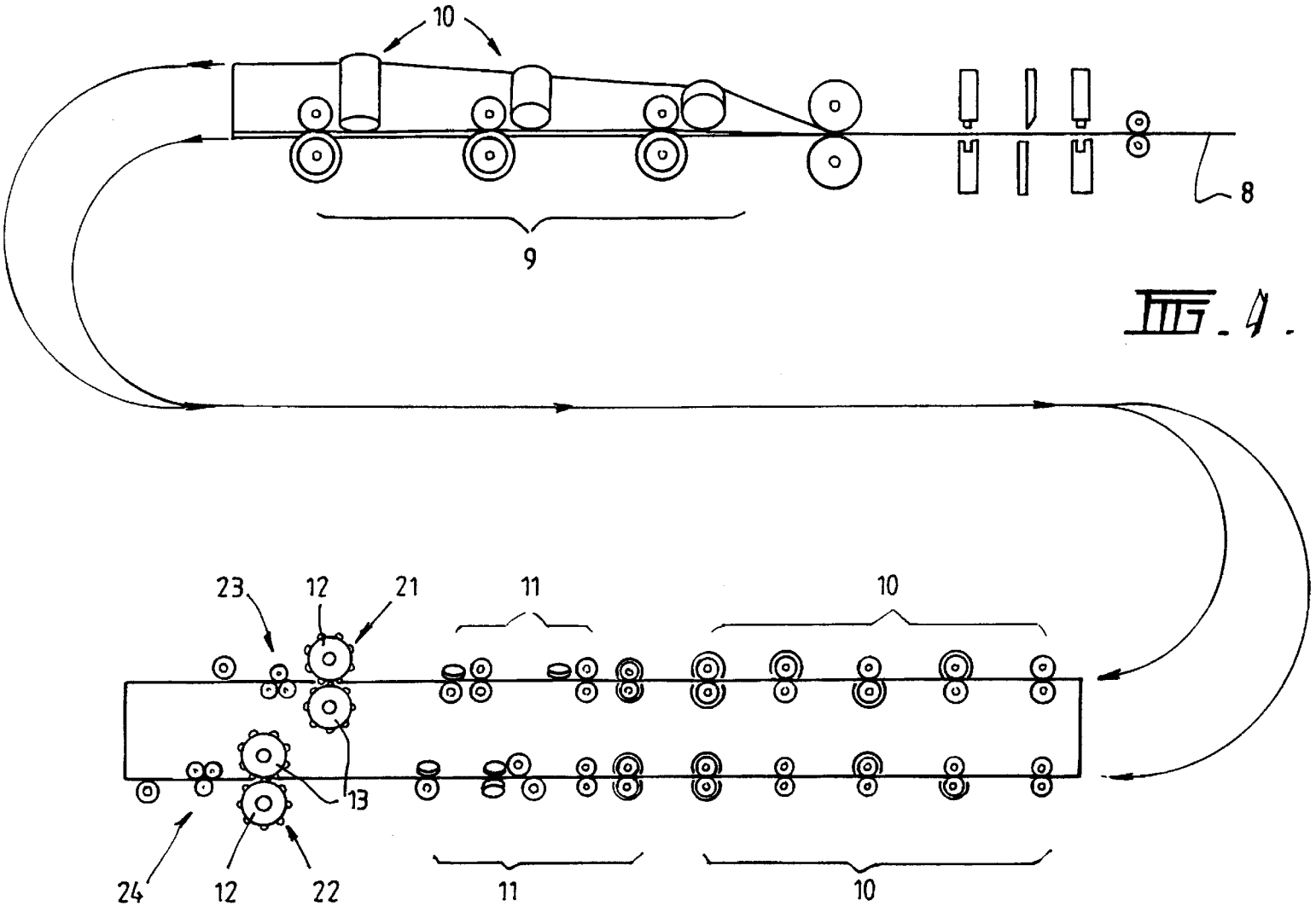
FIG. 4 is a schematic view of the apparatus illustrated in FIG. 2.

The embodiment of a building element formed in accordance with the invention illustrated in FIG. 1 comprises an elongate sheet metal building element 1 of cold-rolled steel having a generally channel shaped cross-section comprising a web 2 and side walls 3 in which the web 2 is provided with longitudinally extending strengthening ribs 4 and the side walls 3 are provided with transverse ribs or corrugations 5 extending across at least part of each side wall 3 with each free edge margin of each side wall 3 being flanged 6.

A preferred embodiment of apparatus in accordance with the invention is illustrated in FIGS. 2 to 8. The illustrated apparatus comprises a continuous cold-forming line having a coil 7 of cold-rolled steel strip 8, a series of forming rolls 9 to bend the strip 8 into a channel member having a web 2 and divergent side walls 3, longitudinal rib-forming rolls 10 to form longitudinal stiffening ribs 4 in the web 2, flange-forming rolls 11 to profile the free edge margin of each side wall 3, transverse rib-forming means in the form of two pairs 21, 22 of transverse rib-forming rolls 12, 13, each pair of rolls 12, 13 engaging a respective side wall 3.

Each side wall 3 passes through the nip of its respective pair of rolls 12, 13, which comprise cylindrical rolls having respectively a plurality of mating projections 34 and recesses 35, elongated axially bf the rolls 12, 13 and spaced apart on their circumference. The rolls 12, 13 of each roll pair 21, 22 are geared to each other to maintain mating projections 34 and recesses 35 in register with each other thereby portions of the strip material are pushed into the recesses to permanently deform the strip to form the ribs 5.

Additionally each roll pair 12, 13 is geared to each other to maintain the ribs 5 formed in one side wall 3 in register with those formed in the other side wall 3.

Alternatively they may be geared to maintain any predetermined relationship between the ribs of the respective side walls with one another.

Stress relief means for applying compression load to the transverse ribs are provided immediately downstream of each pair of transverse rib-forming rolls 12, 13.

The stress relief means 23, 24 comprises a first roller means and a second roller means forming a nip for receiving ribbed strip 8, wherein each roller means is disposed to engage an outer crest portion of each rib 5 projecting towards it. The second roller means comprises a pair of substantially parallel coextensive spaced apart second rollers 14, 15 and the first roller means comprises a first roller 16, said first roller 16 being substantially parallel to, coextensive with and equi-spaced from each of said second rollers 14, 15.

As illustrated in FIG. 1, the transverse ribs 5 comprise corrugations being substantially sinusoidal in cross-section.

Figure 7:
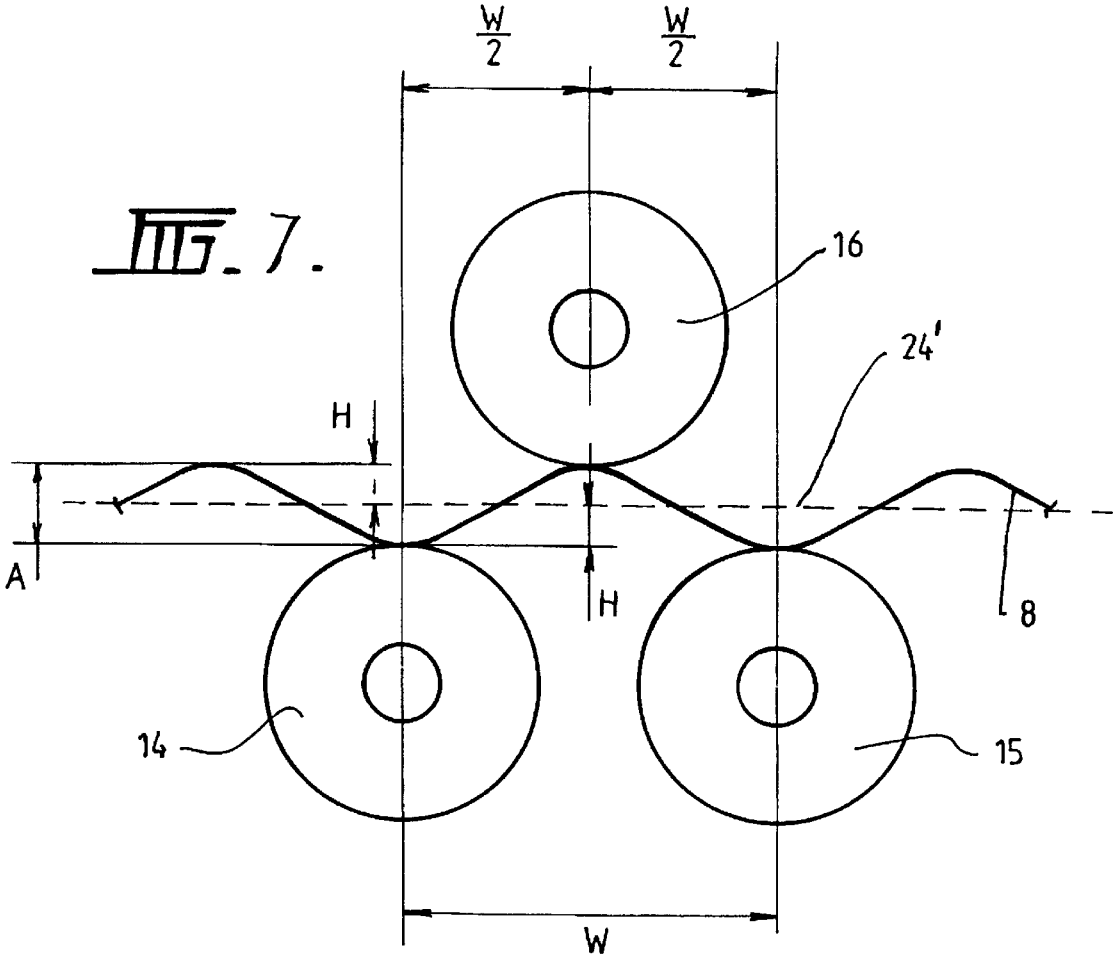
FIG. 7 is a schematic view of stress relief means and corrugated strip passing therethrough in accordance with the invention.
Figure 8:
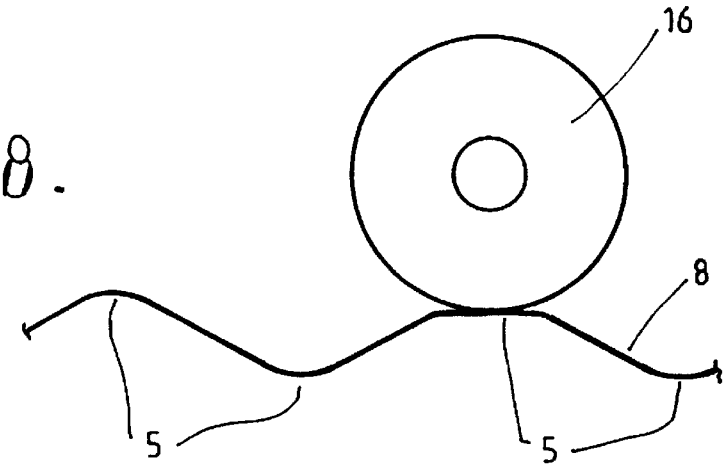
FIG. 8 is a schematic view of a stress relief roller and corrugated strip in which the compressive load distortion of the strip is exaggerated.
Figure 9:
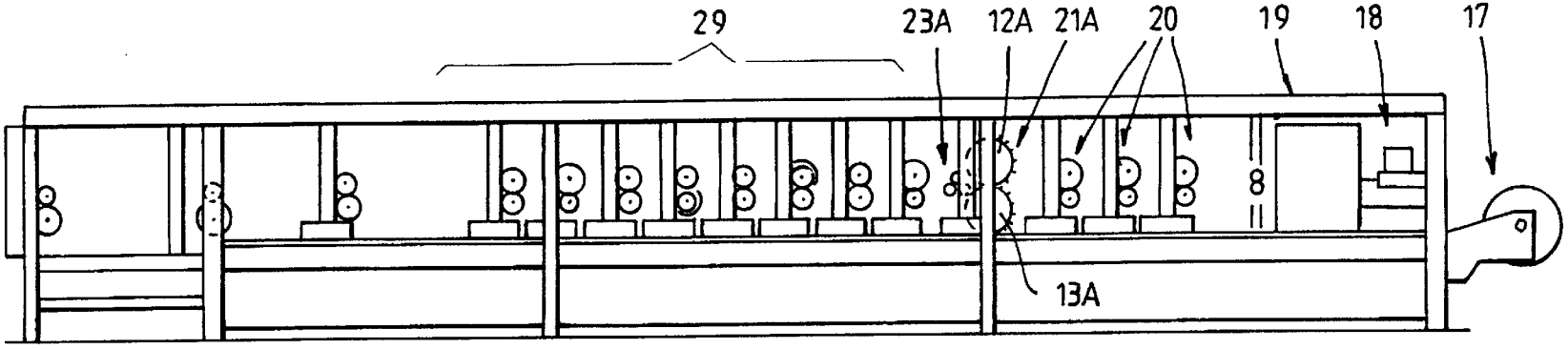
FIG. 9 is a side view of apparatus in accordance with another preferred embodiment of the invention.
Figure 10:
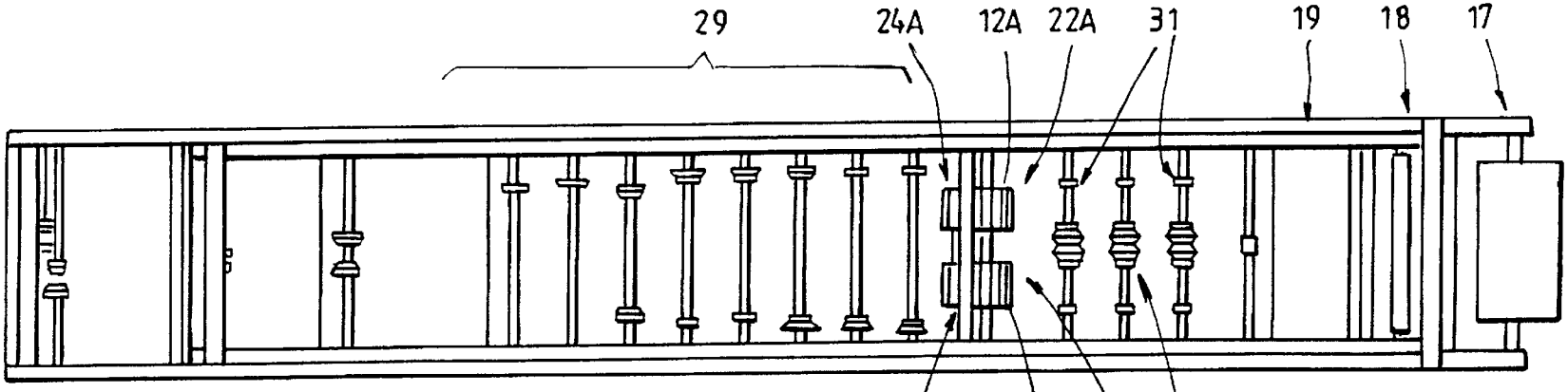
FIG. 10 is a plan view of apparatus illustrated in FIG. 9.
Figure 11:
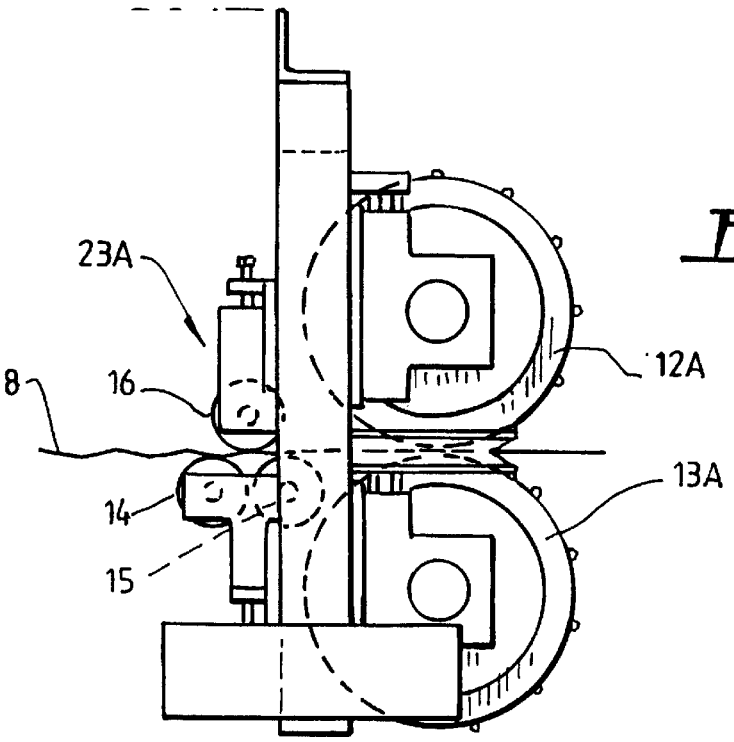
FIG. 11 is a side view of important components of the apparatus illustrated in FIG. 9.
Figure 13:
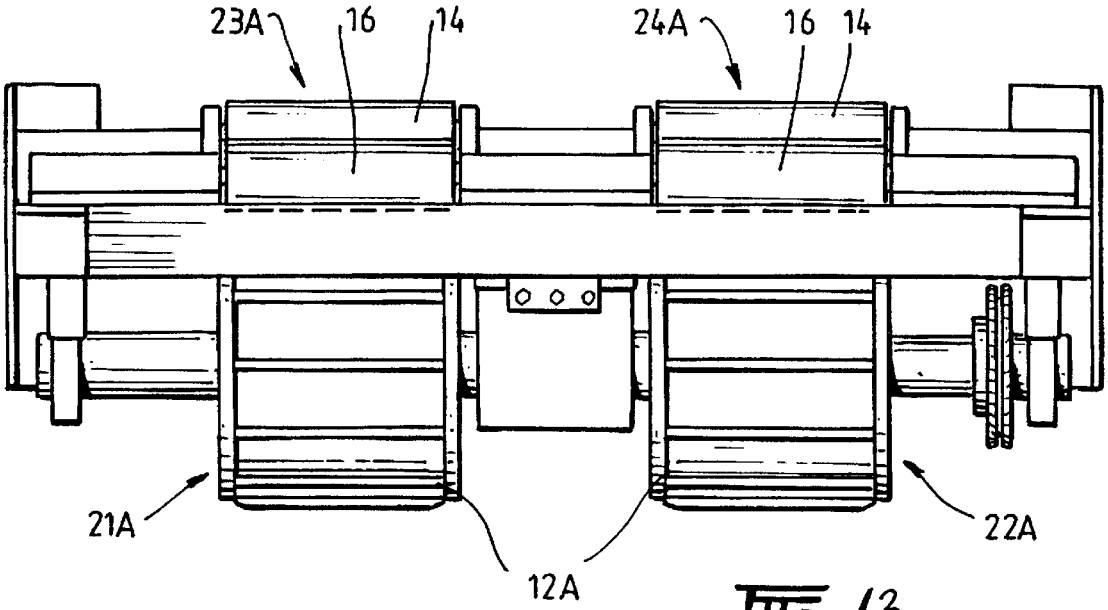
FIG. 13 is a plan view of components illustrated in FIG. 12.
Figure 12:
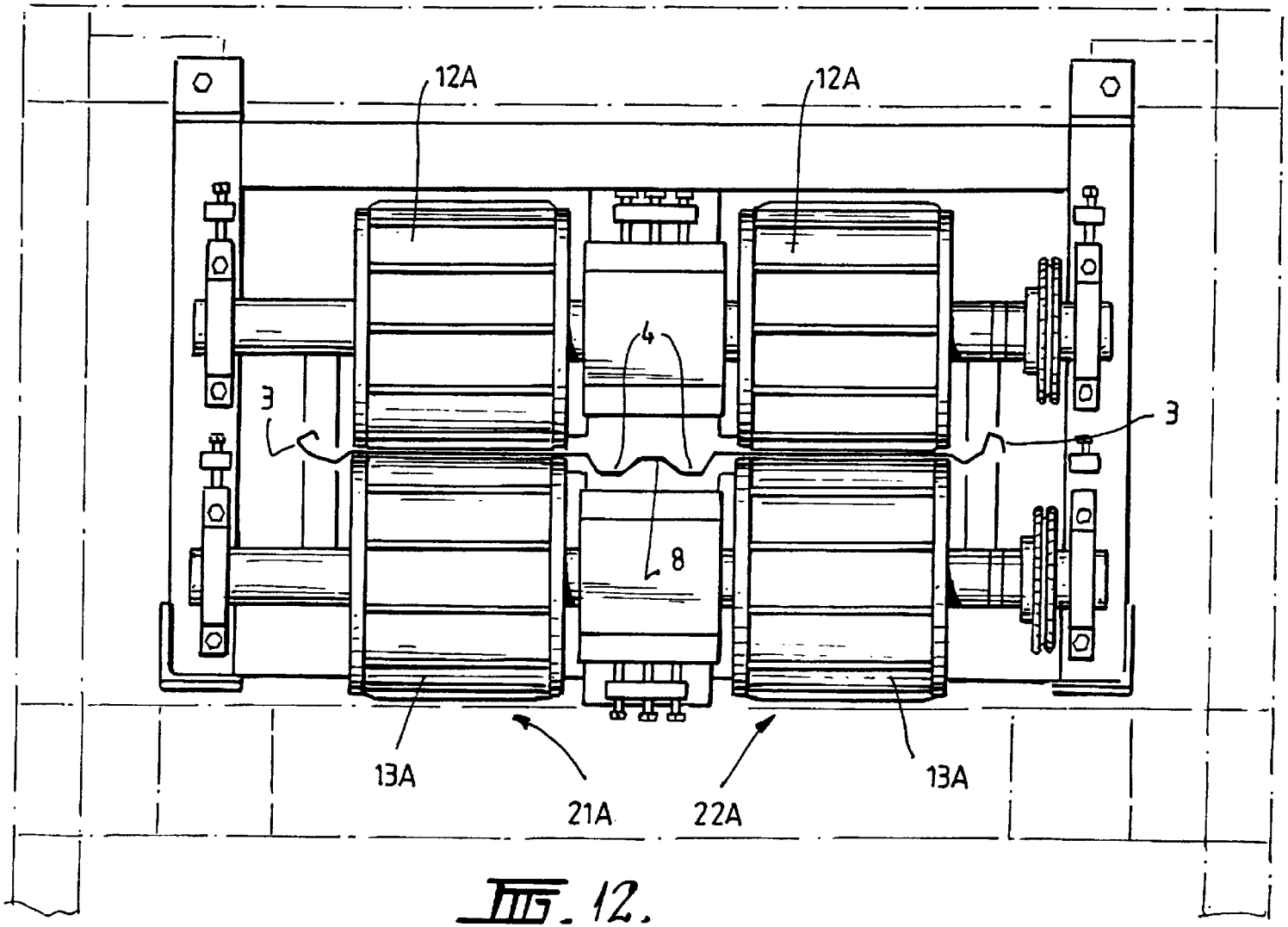
FIG. 12 is an end view of components illustrated in FIG. 11.

As best seen in FIGS. 6, 7 and 8 each roller 14, 15, 16 of the stress relief means 23, 24 applies a compression load to its respective ribs 5 to at least partially relieve stresses in the strip 8 produced by the rib-forming means 12, 13 and more specifically engage only the outer crest portions of the respective corrugations 5.

As illustrated in FIGS. 6 and 7 the second rollers 14, 15 lie in a common plane substantially parallel to the plane of the strip 8 and are spaced apart so that their longitudinal axes are spaced apart a distance [W] corresponding to the distance [W] between crests of adjacent corrugations 5 projecting towards them.

Additionally the first and second rollers 16, 14 and 15, are set a predetermined distance [H] from the nominal plane 24' of the strip 8, said distance [H] being less than the height [A/2] of the corrugations 5 from the nominal plane of the strip 8. The predetermined distance [H] is sufficiently less than said height [A/2] so that the rollers 14, 15, 16 compress the crest portions of the respective ribs 5 without permanent deformation thereof to effect at least partial relief of stress therein. FIG. 8 illustrates an exaggerated deformation of the crest of a rib as it passes a roller 16. Over compression causes permanent deformation of the ribs 5, whereas too little compression has little or no effect on the strip 8. The predetermined distance [H] can be set prior to the commencement of operation or immediately thereafter. The relative displacement of the rollers from the nominal plane can be adjusted during operation of the line with the displacement being set once straight, distortion free strip begins to issue from the line. Additionally, the stress relief means according to the invention may be adjusted and set to account for variations in the quality of the strip issuing therefrom that may occur during operation of the line.

Another preferred embodiment of apparatus in accordance with the invention is illustrated in FIGS. 9 to 13. The illustrated apparatus comprises a continuous cold-forming line provided with an uncoiling assembly 17 having a coil of cold-rolled steel strip, a feed roll assembly 18 to feed strip from coil to the other components of the line, a shear assembly 19 to cut the strip into predetermined lengths, said shear assembly being disposed downstream of the feed roll assembly 18, longitudinal rib-forming rolls 20 to form longitudinal stiffening ribs 4 in the web being disposed in advance of transverse rib-forming means in the form of two pairs 21A, 22A of transverse rib-forming rolls 12A, 13A, each pair of rolls 12A, 13A engaging a respective side wall 3, stress relief means 23A, 24A for applying compression load to the transverse ribs, the stress relief means 23A, 24A being are provided immediately downstream of each pair of transverse rib-forming rolls 12A, 13A, and a series of forming rolls 29 to bend the strip into a channel member having a web 2 and divergent side walls 3 and to profile the free edge margin of each side wall 3, provided downstream of the stress relief means 23A, 24A.

This latter described embodiment differs from the former described embodiment primarily in that the transverse-rib forming means and stress relief means are disposed in advance of the channel-forming rolls and flange forming rolls.

It has surprisingly been found that the sequence of cold forming operations and equipment in the line can be changed without undue detriment to the quality of the cold-formed building elements produced, provided only that the transverse rib-forming means is disposed immediately in advance of the stress relief means in accordance with the invention.

It has been found that the present invention enables the strip issuing from the nip of the transverse rib-forming rolls to be at least partially relieved of residual tensile stresses without the strip being held in tension as it passes through the nip. It also been found that the present invention provides an elegantly simple and inexpensive means of providing stress relief to such strip.

Particular embodiments of the invention has been described and illustrated by way of example, but it will be appreciated that other variations of and modifications to the invention can take place without departing from the spirit and scope of the invention. For example, the transverse rib-forming means and stress relief means may be provided upstream of longitudinal flange-forming means with the transverse ribs being formed prior to the longitudinal bending and flange forming operations. Further the stress relief rollers may be coated with an elastomeric material. The elastomeric material may, for example, be neopene or other hard elastomer. Additionally, the coiled strip may be provided with a corrosion-resistant coating, such as, for example, an aluminum zinc alloy, a thin paint coating or other coating.

In the claims which follow and in the preceding summary of the invention, except where the context requires otherwise due to express language or necessary implication, the word "comprising" is used in the sense of "including", ie the features specified may be associated with further features in various embodiments of the invention.

What is claimed is:

1. A cold-forming line for continuously forming a metal building element from a strip, said building element having transverse ribs extending across part only of the element, the cold-forming line comprising:

means for forming transverse ribs in part only of the strip; and stress relief means including first roller means and second roller means together forming a nip for receiving the partly ribbed strip whereby each roller means is adapted to engage an outer crest portion of each rib respectively projecting towards each said roller means wherein said stress relief means applies compression load to the transverse ribs to at least partly reduce distortion of the partly ribbed strip.

2. A cold-forming line as defined in claim 1 wherein the second roller means comprises a pair of substantially parallel coextensive spaced apart second rollers.

3. A cold-forming line as defined in claim 2 wherein the first roller means comprises a first roller, said first roller being substantially parallel to, coextensive with and equi-spaced from each of said second rollers.

4. A cold-forming line as defined in claim 3 wherein each said roller applies a compression load to its respective ribs to at least partially relieve stresses in the partly ribbed strip produced by the rib forming means.

5. A cold-forming line as defined in claim 2 wherein the rollers engage only the outer crest portions of the respective ribs.

6. A cold-forming line as defined in claim 2 wherein the second rollers lie in a common plane substantially parallel to the plane of the strip and are spaced apart so that their longitudinal axes are spaced apart a distance corresponding to the distance between crests of adjacent ribs projecting towards them.

7. A cold-forming line as defined in claim 1 wherein the first and second roller means are set a predetermined distance from the nominal plane of the stripe said distance being less than the height of the ribs from the nominal plane of the strip.

8. A cold-forming line as defined in claim 7 wherein the predetermined distance may be sufficiently less than said height so that the roller means compress the crest portions of the respective ribs without permanent deformation thereof to effect at least partial relief of stress therein.

9. A cold-forming line as defined in claim 7 wherein the predetermined distances are set prior to the commencement of operation or immediately thereafter.

10. A cold-forming line as defined in claim 1 wherein the relative displacement of the roller means from the nominal plane of the strip is adjusted during operation of the line with the displacement being set once substantially straight, strip substantially devoid of unwanted distortion begins to issue from the line.

11. A cold-forming line as defined in claim 1 wherein the stress relief means is adjusted and set to account for variations in the quality of the strip issuing there from that occur during operation of the line.

12. A cold-forming line as defined in claim 1 wherein the line further comprises flange forming means and that the stress relief means is provided immediately downstream of the rib-forming means.

13. A cold-forming line as defined in claim 1 wherein the transverse rib-forming means comprises a pair of cylindrical rolls having respectively a plurality of mating projections and recesses, elongated axially of the rolls and spaced apart on their circumference.

14. A cold-forming line as defined in claim 13 wherein the cylindrical rolls form a nip through which the strip passes and the rolls are geared to each other to maintain mating projections and recesses in register with each other thereby portions of the strip material are pushed into the recesses to permanently deform the strip to form the ribs.

15. A cold-forming line as defined in claim 1 wherein the transverse ribs comprise corrugations.

16. A cold-forming line as defined in claim 14 wherein the corrugations are substantially sinusoidal in cross-section.

17. A cold-forming line as defined in claim 1 further including means to provide the building elements with a generally channel shaped cross-section comprising a web and side walls in which the web is provided with longitudinally extending strengthening ribs and the side walls are provided with said transverse ribs or corrugations extending across at least part of each side wall.

18. A cold-forming line as defined in claim 17 wherein each free edge margin of each side wall is flanged by downstream rolls engaging only the edge margins of the strip.

19. A method of cold-forming a metal building element from a strip, said building element having transverse ribs extending across part only of the element, said method comprising the steps of:

passing the strip to means for forming transverse ribs in part only of the strip; and passing the partly ribbed strip to stress relief means including first roller means and second roller means forming a nip for receiving ribbed strip, whereby each roller means is adapted to engage an outer crest portion of each rib projecting towards each said roller means wherein said stress relief means applies compression load to the transverse ribs to at least partly reduce distortion of the partly ribbed strip.

20. A method as defined in claim 19 wherein the second roller means comprises a pair of substantially parallel coextensive spaced apart second rollers.

21. A method as defined in claim 20 wherein the first roller means comprises a first roller, said first roller being substantially parallel to, coextensive with and equi-spaced from each of said second rollers.

22. A method as defined in claim 20 wherein each roller applies a compression load to its respective ribs to at least partially relieve stresses in the strip produced by the rib forming means.

23. A method as defined in claim 19 wherein the roller means engage only the outer crest portions of the respective ribs.

24. A method as defined in claim 20 wherein the second rollers lie in a common plane substantially parallel to the plane of the strip and are spaced apart so that their longitudinal axes are spaced apart a distance corresponding to the distance between crests of adjacent ribs projecting towards them.

25. A method as defined in claim 19 comprising the further step of setting the first and second roller means a predetermined distance from the nominal plane of the strip, said distance being less than the height of the ribs from the nominal plane of the strip.

26. A method as defined in claim 19 wherein the roller means compress the crest portions of respective ribs extending towards them without permanent deformation thereof to effect at least partial relief of stress therein.

27. A method as defined in claim 25 wherein the step of setting the predetermined distance is performed prior to the commencement of operation.

28. A method as defined in claim 25 wherein the further step of adjusting the relative displacement of the roller means from the nominal plane is performed during operation of the line with the displacement being set once substantially straight strip substantially devoid of unwanted distortion begins to issue from the line.

29. A method as defined in claim 19 comprises the further step of adjusting and setting the stress relief means to account for variations in the quality of the strip issuing therefrom that occur during operation of the line.

30. A method as defined in claim 19 wherein the step of stress relief occurs downstream of the rib-forming step.

31. A method as defined in claim 19 wherein the step of forming transverse ribs is performed by means of a pair of cylindrical rolls having respectively a plurality of mating projections and recesses, elongated axially of the rolls and spaced apart on their circumference.

32. A method as defined in claim 31 wherein the cylindrical rolls form a nip through which the strip passes and the rolls are geared to each other to maintain mating projections and recesses in register with each other thereby portions of the strip material are pushed into the recesses to permanently deform the strip to form the ribs.

* * * * *